US007731809B2

(12) United States Patent
Hu

(10) Patent No.: US 7,731,809 B2
(45) **Date of Patent: *Jun. 8, 2010**

(54) ACTIVATED DIFFUSION BRAZING ALLOYS AND REPAIR PROCESS

(75) Inventor: Yiping Hu, Greer, SC (US)

(73) Assignee: Honeywell International Inc., Morristown, NJ (US)

( * ) Notice: Subject to any disclaimer, the term of this patent is extended or adjusted under 35 U.S.C. 154(b) by 311 days.

This patent is subject to a terminal disclaimer.

(21) Appl. No.: 11/336,305

(22) Filed: Jan. 18, 2006

(65) Prior Publication Data

US 2007/0163684 A1 Jul. 19, 2007

(51) Int. Cl.
*C22C 19/05* (2006.01)
*B23K 35/30* (2006.01)

(52) U.S. Cl. ..... 148/428; 420/445; 228/119

(58) Field of Classification Search ..... 75/228–254, 75/302; 148/428; 228/119, 248.1, 262.31; 420/445

See application file for complete search history.

(56) References Cited

U.S. PATENT DOCUMENTS

| | | | | |
|---|---|---|---|---|
| 3,759,692 | A * | 9/1973 | Zelahy | 75/255 |
| 4,478,638 | A * | 10/1984 | Smith et al. | 75/255 |
| 4,507,264 | A * | 3/1985 | Stern | 420/443 |
| 4,910,098 | A | 3/1990 | Lee et al. | |
| 4,940,566 | A * | 7/1990 | Wood et al. | 420/443 |
| 5,040,718 | A | 8/1991 | Lee et al. | |
| 5,240,491 | A * | 8/1993 | Budinger et al. | 75/255 |
| 5,320,690 | A | 6/1994 | Beltran et al. | |
| 5,395,584 | A * | 3/1995 | Berger et al. | 420/443 |
| 5,437,737 | A * | 8/1995 | Draghi et al. | 148/23 |
| 5,536,022 | A * | 7/1996 | Sileo et al. | 277/415 |
| 5,666,643 | A * | 9/1997 | Chesnes et al. | 428/549 |
| 5,735,448 | A * | 4/1998 | Draghi et al. | 228/119 |
| 5,783,318 | A * | 7/1998 | Biondo et al. | 428/680 |
| 5,806,751 | A * | 9/1998 | Schaefer et al. | 228/119 |
| 6,454,885 | B1 | 9/2002 | Chesnes et al. | |
| 6,520,401 | B1 | 2/2003 | Miglietti | |
| 6,530,971 | B1 | 3/2003 | Cohen et al. | |
| 6,629,368 | B2 * | 10/2003 | Schnell et al. | 29/889.1 |
| 6,726,086 | B2 | 4/2004 | Philip | |
| 6,890,370 | B2 * | 5/2005 | Merrick et al. | 75/246 |
| 2002/0185198 | A1 | 12/2002 | Pietruska et al. | |
| 2003/0136811 | A1 | 7/2003 | Philip | |

(Continued)

FOREIGN PATENT DOCUMENTS

WO WO 03/025237 A1 * 3/2003

*Primary Examiner*—George Wyszomiersi
*Assistant Examiner*—Mark L Shevin
(74) *Attorney, Agent, or Firm*—Ingrassia Fisher & Lorenz, P.C.

(57) ABSTRACT

The present invention provides a low-melt nickel-based alloy powder applied in an activated diffusion brazing repair on gas turbine components. In one embodiment, and by way of example only, the low-melt alloy powder comprises between about 6.7% and about 9.2% by weight Cr, between about 9.7% and about 10.3% by weight Co, between about 3.7% and about 4.7% by weight W, between about 3.3% and about 6.3% by weight Ta, between about 3.6% and about 5.2% by weight Al, between about 1.3% and about 4.0% by weight Hf, between about 0.02% and about 0.06% by weight C, between about 1.0% and about 3.2% by weight B, and Ni. Optionally, the low-melt alloy powder may include between about 1.4% and about 3.2% by weight Re.

10 Claims, 3 Drawing Sheets

U.S. PATENT DOCUMENTS

2004/0050909 A1* 3/2004 Renteria et al. ..... 228/119
2004/0121182 A1 6/2004 Hardwicke et al.
2005/0097986 A1 5/2005 Okada et al.

* cited by examiner

ACTIVATED DIFFUSION BRAZING ALLOYS AND REPAIR PROCESS

TECHNICAL FIELD

The present invention relates to repairing gas turbine components manufactured from superalloys and, more particularly, to brazing alloys and processes applied in the repair.

BACKGROUND

Turbine engines are used as the primary power source for various kinds of aircrafts. The engines may also serve as auxiliary power sources that drive air compressors, hydraulic pumps, and industrial gas turbine (IGT) power generation. Further, the power from turbine engines may be used for stationary power supplies such as backup electrical generators for hospitals and the like.

Most turbine engines generally follow the same basic power generation procedure. Compressed air is mixed with fuel and burned, and the expanding hot combustion gases are directed against stationary turbine vanes in the engine. The vanes turn the high velocity gas flow partially sideways to impinge on the turbine blades mounted on a rotatable turbine disk. The force of the impinging gas causes the turbine disk to spin at high speed. Jet propulsion engines use the power created by the rotating turbine disk to draw more air into the engine and the high velocity combustion gas is passed out of the gas turbine aft end to create forward thrust. Other engines use this power to turn one or more propellers, electrical generators, or other devices.

Because fuel efficiency increases as engine operating temperatures increase, turbine engine blades and vanes are typically fabricated from high-temperature materials such as nickel-based and cobalt-based superalloys. However, although nickel-based superalloys have good high temperature properties and many other advantages, they are susceptible to corrosion, oxidation, thermal fatigue and erosion damage in the high temperature environment during turbine engine operation. In such cases, the turbine nozzle guide vanes may need to be repaired, such as, by a brazing process.

Brazing processes typically employ a braze alloy mixture that includes a high-melt alloy and a low-melt alloy. The high-melt alloy usually is substantially similar to or better than the component alloy being repaired. The low-melt alloy typically comprises a braze alloy powder that has a lower melting temperature than the high-melt alloy and a relatively small amount of gamma prime and solid solution strengthening alloying elements, which contribute to elevated-temperature properties in brazing repaired components. When the braze alloy mixture is applied to a repair area on the turbine component and subjected to heat in a vacuum furnace, the mixture melts and heals cracks or buildup materials on the repair area. However, it has been found that because currently known braze alloys contain a relatively small amount of gamma prime and solid solution strengthening elements, the metallurgical integrity and performance of the repaired components may be inferior to the metallurgical integrity of the base materials under circumstances in which the repaired components are subjected to the elevated temperatures and high-stress loads during engine operation.

Hence, there is a need for improved materials for repairing turbine engine components such as the turbine nozzles and vanes. There is a particular need for repair materials that will improve a turbine component's durability, and for efficient and cost effective methods of repairing the components using such materials.

BRIEF SUMMARY

The present invention provides low-melt alloys for application in brazing repair processes on gas turbine engine components. In one embodiment, and by way of example only, the low-melt alloy powder comprises between about 6.7% and about 9.2% by weight Cr, between about 9.7% and about 10.3% by weight Co, between about 3.7% and about 4.7% by weight W, between about 3.3% and about 6.3% by weight Ta, between about 3.6% and about 5.2% by weight Al, between about 1.3% and about 4.0% by weight Hf, between about 0.02% and about 0.06% by weight C, between about 1.0% and about 3.2% by weight B, and Ni.

In another embodiment, and by way of example only, a braze alloy composition for repairing a component comprising a superalloy material is provided. The braze alloy mixture includes a high-melt alloy powder comprising the metal material and a low-melt alloy powder. The low-melt alloy powder including at least about 6.7% by weight Cr, between about 9.7% and about 10.3% by weight Co, between about 3.7% and about 4.7% by weight W, at least about 3.3% by weight Ta, at least about 3.6% by weight Al, at least about 1.3% by weight Hf, between about 0.02% and about 0.06% by weight C, at least about 1.0% by weight B, and Ni.

In still another embodiment, a method is provided for repairing a component comprising a superalloy material having a damage area therein. The method includes the step of applying a braze alloy mixture to the damage area of the turbine airfoil, the braze alloy mixture including a high-melt alloy powder comprising the metal material, and a low-melt alloy powder comprising at least about 6.7% by weight Cr, between about 9.7% and about 10.3% by weight Co, between about 3.7% and about 4.7% by weight W, at least about 3.3% by weight Ta, at least about 3.6% by weight Al, at least about 1.3% by weight Hf, between about 0.02% and about 0.06% by weight C, at least about 1.0% by weight B, and Ni.

Other independent features and advantages of the preferred repair material and process will become apparent from the following detailed description, taken in conjunction with the accompanying drawings which illustrate, by way of example, the principles of the invention.

DETAILED DESCRIPTION OF A PREFERRED EMBODIMENT

Figure 1:
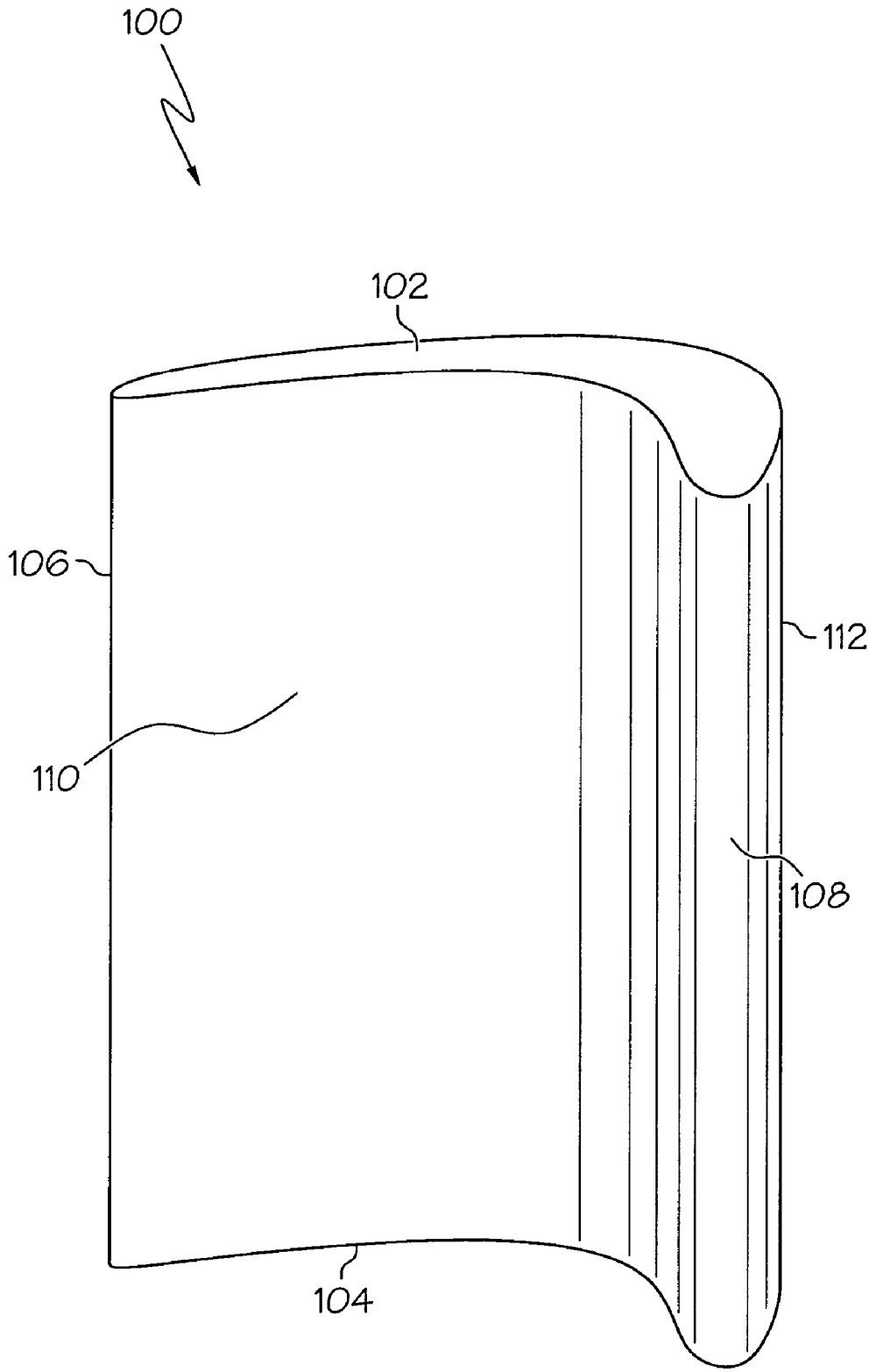
FIG. 1 is a perspective view of a turbine vane in accordance with an exemplary embodiment.

The following detailed description of the invention is merely exemplary in nature and is not intended to limit the invention or the application and uses of the invention. Furthermore, there is no intention to be bound by any theory presented in the preceding background of the invention or the following detailed description of the invention.

An improved repair material is provided herein for use in repairing high pressure turbine (HPT) components such as turbine vanes to improve resistance to degradation due to corrosion, oxidation, thermal fatigue, and other hazards. The repair material is preferably used in a brazing process and includes a high-melt superalloy powder and a low-melt alloy powder. Preferably, the high-melt superalloy powder comprises elements with concentrations that are substantially similar to or better than the material from which the HPT component to be repaired is formed. For example, the HPT components may be formed from high-performance Ni-based superalloys such as IN713, IN738, IN792, C101, MarM247, SC180, CMSX3, CMSX 4, and the like. Accordingly, the high-melt superalloy powder may comprise one of the previously mentioned high performance Ni-based superalloys.

The low-melt alloy powder is a nickel-based alloy powder broadly defined as comprising chromium, cobalt, tungsten, tantalum, aluminum, hafnium, carbon, and boron. The low-melt alloy powder may additionally include rhenium. In one exemplary embodiment of the low-melt powder material, the low-melt nickel-base alloy powder includes each of these elements with a concentration (weight %) of at least about 6.7% chromium, cobalt ranging between about 9.7% and about 10.3%, tungsten ranging between about 3.7% and about 4.2%, at least about 3.3% tantalum, at least about 3.6% aluminum, at least about 1.3% hafnium, carbon ranging between about 0.02% and about 0.06%, and at least about 1.0% boron.

In another exemplary embodiment, the low-melt nickel-based alloy powder includes chromium ranging between about 8.7% and about 9.2%, cobalt ranging between about 9.7% and about 10.3%, tungsten ranging between about 3.7% and about 4.2%, tantalum ranging between about 3.3% and about 3.7%, aluminum ranging between about 3.6% and about 4.0%, hafnium ranging between about 1.3% and about 1.7%, carbon ranging between about 0.02% and about 0.06%, and boron ranging between about 2.3% and about 2.7%. Most preferably, chromium is included at a concentration of about 9.0%, cobalt is included at a concentration of about 10.0%, tungsten is included at a concentration of about 4.0%, tantalum is included at a concentration of about 3.5%, aluminum is included at a concentration of about 3.8%, hafnium is included at a concentration of about 1.5%, carbon is included at a concentration of about 0.04%, and boron is included at a concentration of about 2.5%.

In still another exemplary embodiment of the low-melt material, the low-melt alloy powder includes, by concentration (weight %) chromium ranging between about 6.7% and about 7.3%, cobalt ranging between about 9.7% and about 10.3%, tungsten ranging between about 3.7% and about 4.2%, tantalum ranging between about 5.7% and about 6.3%, aluminum ranging between about 4.8% and about 5.2%, hafnium ranging between about 1.3% and about 1.7%, carbon ranging between about 0.02% and about 0.06%, and boron ranging between about 2.8% and about 3.2% and rhenium ranging between about 2.8% and about 3.2%. Most preferably, chromium is included at a concentration of about 7.0%, cobalt is included at a concentration of about 10.0%, tungsten is included at a concentration of about 4.0%, tantalum is included at a concentration of about 6.0%, aluminum is included at a concentration of about 5.0%, hafnium is included at a concentration of about 1.5%, carbon is included at a concentration of about 0.04%, boron is included at a concentration of about 3.0%, and rhenium is included at a concentration of about 3.0%.

In still another exemplary embodiment, the low-melt nickel-based alloy powder includes chromium ranging between about 8.3% and about 8.8%, cobalt ranging between about 9.7% and about 10.3%, tungsten ranging between about 4.2% and about 4.7%, tantalum ranging between about 3.7% and about 4.2%, aluminum ranging between about 3.8% and about 4.2%, hafnium ranging between about 3.3% and about 3.7%, carbon ranging between about 0.02% and about 0.06%, and boron ranging between about 1.0% and about 1.3%. Most preferably, chromium is included at a concentration of about 8.5%, cobalt is included at a concentration of about 10.0%, tungsten is included at a concentration of about 4.5%, tantalum is included at a concentration of about 4.0%, aluminum is included at a concentration of about 4.0%, hafnium is included at a concentration of about 3.5%, carbon is included at a concentration of about 0.04%, and boron is included at a concentration of about 1.15%.

In still yet another exemplary embodiment, the low-melt nickel-based alloy powder includes chromium ranging between about 8.3% and about 8.8%, cobalt ranging between about 9.7% and about 10.3%, tungsten ranging between about 4.2% and about 4.7%, tantalum ranging between about 3.7% and about 4.2%, aluminum ranging between about 3.8% and about 4.2%, hafnium ranging between about 3.3% and about 3.7%, carbon ranging between about 0.02% and about 0.06%, boron ranging between about 1.0% and about 1.3%, and rhenium ranging between about 1.4% and about 1.8%. Most preferably, chromium is included at a concentration of about 8.5%, cobalt is included at a concentration of about 10.0%, tungsten is included at a concentration of about 4.5%, tantalum is included at a concentration of about 4.0%, aluminum is included at a concentration of about 4.0%, hafnium is included at a concentration of about 3.5%, carbon is included at a concentration of about 0.04%, boron is included at a concentration of about 1.15%, and rhenium is included at a concentration of about 1.6%.

The acceptable concentrations of the elements in the low-melt nickel-based alloy powder, along with preferred embodiments, are presented in Table 1. In all of the various embodiments, the balance of the concentration is preferably nickel, though the balance could be nickel and one or more other elements that may, for example, be present in trace amounts.

TABLE 1

| | Embodiment 1 | | Embodiment 2 | |
|---|---|---|---|---|
| Element | [wt. %] Range | Most Preferred [wt. %] Range | [wt. %] Range | Most Preferred [wt. %] Range |
| Cr | 8.7-9.2 | 9.0 | 6.7-7.3 | 7.0 |
| Co | 9.7-10.3 | 10.0 | 9.7-10.3 | 10.0 |
| W | 3.7-4.2 | 4.0 | 3.7-4.2 | 4.0 |
| Ta | 3.3-3.7 | 3.5 | 5.7-6.3 | 6.0 |
| Al | 3.6-4.0 | 3.8 | 4.8-5.2 | 5.0 |
| Hf | 1.3-1.7 | 1.5 | 1.3-1.7 | 1.5 |
| C | 0.02-0.06 | 0.04 | 0.02-0.06 | 0.04 |
| B | 2.3-2.7 | 2.5 | 2.8-3.2 | 3.0 |
| Re | — | — | 2.8-3.2 | 3.0 |
| Ni | balance | balance | balance | balance |

| | Embodiment 3 | | Embodiment 4 | |
|---|---|---|---|---|
| Element | [wt. %] Range | Most Preferred [wt. %] Range | [wt. %] Range | Most Preferred [wt. %] Range |
| Cr | 8.3-8.8 | 8.5 | 8.3-8.8 | 8.5 |
| Co | 9.7-10.3 | 10.0 | 9.7-10.2 | 10.0 |
| W | 4.2-4.7 | 4.5 | 4.2-4.7 | 4.5 |
| Ta | 3.7-4.2 | 4.0 | 3.7-4.2 | 4.0 |
| Al | 3.8-4.2 | 4.0 | 3.8-4.2 | 4.0 |
| Hf | 3.3-3.7 | 3.5 | 3.3-3.7 | 3.5 |
| C | 0.02-0.06 | 0.04 | 0.02-0.06 | 0.04 |
| B | 1.0-1.3 | 1.15 | 1.0-1.3 | 1.15 |
| Re | — | | 1.4-1.8 | 1.6 |
| Ni | balance | balance | balance | balance |

The ratio at which the high-melt and low-melt alloy powders may be combined depends upon how the repair material will be used. For example, in instances in which the repair material is used to repair cracks, a paste is preferably formed that comprises the repair powder and a chemical binder, where the repair powder makes up between about 85% to about 90% of the repair material and the chemical binder makes up between about 10% to about 15% of the repair material. Moreover, the repair powder may include about 50% of the high-melt superalloy powder and about 50% of the low-melt alloy powder. The chemical binder, which is a suspension medium that is incorporated to hold the high-melt and low-melt alloy powders together and to hold the powders on the surface being repaired, may include, for example, AB215 (available through HiTec Metal Group, Inc. of Cincinnati, Ohio). In another example, the repair material may be used to repair material loss on turbine vanes or to restore a missing piece from the worn component. Here, a preform, such as a preform tape or pre-sintering preform, is preferably formed from the repair material, which preferably comprises between about 60% and about 70% high-melt superalloy powder and between about 30% and about 40% low-melt alloy powder.

As previously mentioned, the repair material can be used to repair and restore both geometry and dimension to a variety of different turbine engine components. For example, the turbine vanes such as nozzle guide vanes in the hot section of a turbine engine are particularly susceptible to wear, oxidation and other degradation. One exemplary turbine vane 100 is depicted in FIG. 1. The turbine vane 100 includes several components that are particularly susceptible to erosion, wear, oxidation, corrosion, cracking, or other damage, and the process of the present invention can be tailored to deposit the nickel-based superalloy on different type of vane airfoils and their individual components. The turbine vane 100 includes a top 102, a bottom 104, a leading edge 106, and a trailing edge 108. The top 102 and bottom 104 are configured to extend through non-illustrated slots that may be formed in a non-illustrated turbine. Extending between the leading and trailing edges 106, 108 are a concave face 110 and a convex face 112. In operation, hot gases and particles may impinge on the leading edge 106 and concave face 110 to thereby provide the driving force for the turbine engine. Thus, the leading edge 106 and concave face 110 may be more susceptible to wear than other sections of the vane 100. It will be appreciated in that in some embodiments, the concave face 110 may be impinged by gases and particles and thus may be more susceptible to wear than the convex face 112.

Figure 2:
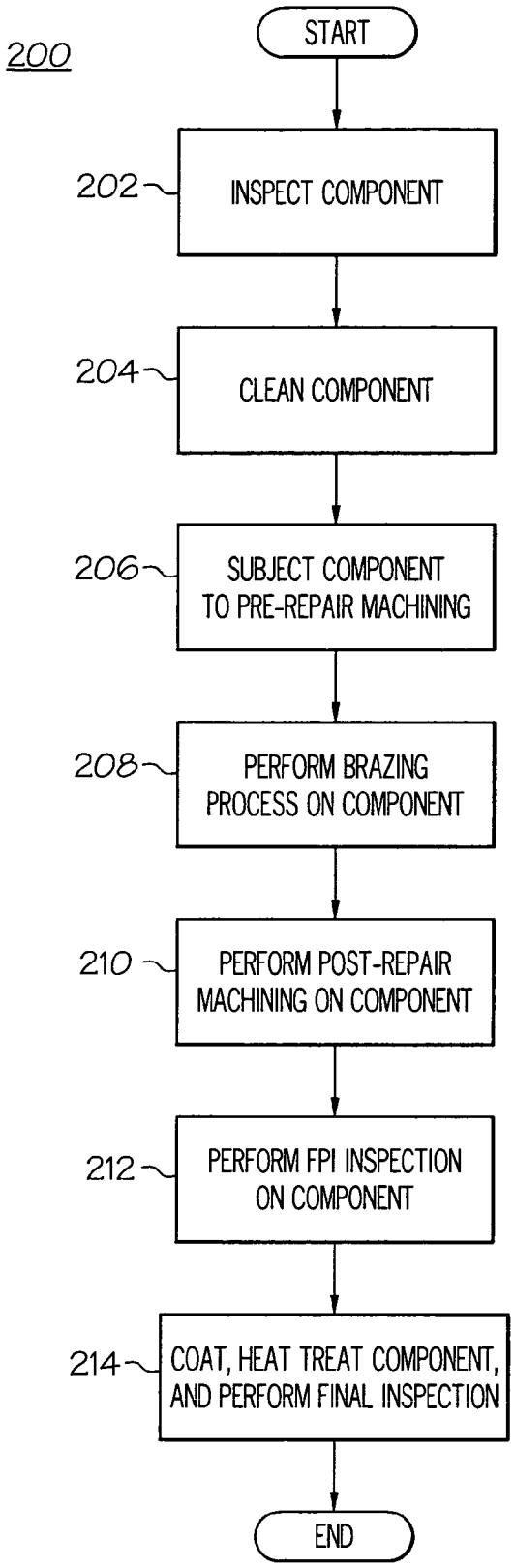
FIG. 2 is a flow diagram of a repair method in accordance with an exemplary embodiment.

Turning now to FIG. 2, an exemplary method 200 is illustrated for repairing turbine vanes, and other turbine components in a flow diagram. Although the following method is described with reference to repair of a turbine vane, it should be understood that the method is in no way limited to vanes or any other particular components.

When one or more worn or degraded turbine vanes are identified after an incoming inspection, they are typically detached from the turbine, step 202. Then, the next step 204 of the method comprises chemically preparing the surface of the turbine component. For example, step 204 may include chemically cleaning the turbine component by stripping a coating from the component. The turbine component may further be mechanically prepared as well, step 206. In such case, the step of mechanically preparing a turbine vane can include one or more processes including pre-repair machining and degreasing the surface to be repaired in order to remove any oxidation and dirt or other materials. In another exemplary embodiment, the preparation additionally includes a fluoride ion cleaning process to remove oxides from the worn vane. The fluoride ion cleaning process may be followed with a high-temperature vacuum cleaning process to remove excess fluoride remainder that may be on the vane. It will be appreciated that the present embodiment is not limited to these preparatory steps, and that additional, or different types and numbers of preparatory steps can be conducted.

Once the turbine vane has been prepared, the next step 208 comprises subjecting the vane to a braze repair process. In an embodiment in which the braze repair process is used to repair a crack, the repair material is made into a paste and applied to the area to be repaired. Then, the component is placed in a vacuum furnace and exposed to a temperature that is sufficiently high to melt the repair material and to cause the material to be drawn into the crack via capillary action. For example, the component may be subjected to a temperature within a range of between about 2150° F. and about 2300° F. for between about 15 and about 45 minutes. It will be appreciated, however, that other temperatures and durations may alternatively be suitable. After the repair material is molten and metallurgically bound onto the component, it may be subjected to a diffusion heat treatment at a temperature below the liquidus temperature of the braze alloy for 4 to 20 hours, which allows boron of the low-melt alloy powder to diffuse into the high-melt superalloy powder and base materials.

In another exemplary embodiment in which the brazing repair process is used to restore a dimension and contour on a worn vane, the repair material is made into a preform tape. Using a preform may be desirable when a materials loss on a large area of the vane airfoil is needed to be uniformly built up. The preform may have a variety of thicknesses, which is useful for uniformly restoring materials loss on the vane. The preform is contacted to the area to be repaired and held against the surface thereof by an organic binder within the tape.

In either case, the repair material has mechanical properties that allow the brazing materials to be compatible with the substrate. Additionally, the repair material has mechanical properties that substantially match or improve upon those of the turbine vane superalloy.

Returning to the flow diagram of FIG. 2, after the repair step 208 is completed at least one post-repair step 210 is performed depending on the type of repair that was performed. For example, post-repair steps may include processes that improve the turbine component's mechanical properties, and metallurgical integrity. For example, processes that include final machining the repaired components to a predetermined design dimension may be performed.

After the machining process step 210 is completed, at least one inspection process can be performed as step 212 to determine whether any surface defects exist, such as cracks or other openings. An inspection process can be conducted using any well-known non-destructive inspection techniques including, but not limited to, a fluorescent penetration inspection ("FPI inspection"), and a radiographic inspection. If brazed components pass a FPI inspection, and then they experience step 214 process. These processes may include recoating with a suitable material such as environment-resistant diffusion aluminide and/or MCrAlY overlay coatings, coating diffusion and aging heat treatments. Then, a final inspection is performed on the repaired components. If the repaired components pass the final inspection, they are ready for use.

Example 1

In one example, samples were used that comprised a SC-180 single crystal superalloy substrate having a nominal composition of about 10% by weight Co, about 5% by weight Cr, about 1.7% by weight Mo, about 5% by weight W, about 3% by weight Re, about 8.5% by weight Ta, about 5.2% by weight Al, about 1.0% by weight Ti, about 0.1% by weight Hf and balance Ni. A repair alloy mixture was prepared including about 50% by weight of a high-melt alloy comprising MarM247 and about 50% by weight of a low-melt alloy formulated as the composition disclosed in Embodiment 1 in Table 1 above. The repair alloy mixture was also mixed with a chemical binder to make a paste, where the repair alloy mixture made up about 88% of the paste and the binder made up about 12% of the paste. The samples each had a 0.010-inch wide crack that was filled with the repair alloy paste. The samples were heated to 1000° F. for 15 minutes in order to burn off the organic binder in the brazing paste. The temperature was then raised to 2200° F. for between about 15 to about 45 minutes. Then, the temperature was reduced to just below the liquidus temperature of the low-melt alloy, and maintained for 4-20 hours to allow a solid state diffusion to occur, and the repaired area or brazing joint was metallurgically homogenized. Afterwards, the samples were solution heat treated, followed by a coating diffusion and aging heat treatment.

Figure 3:
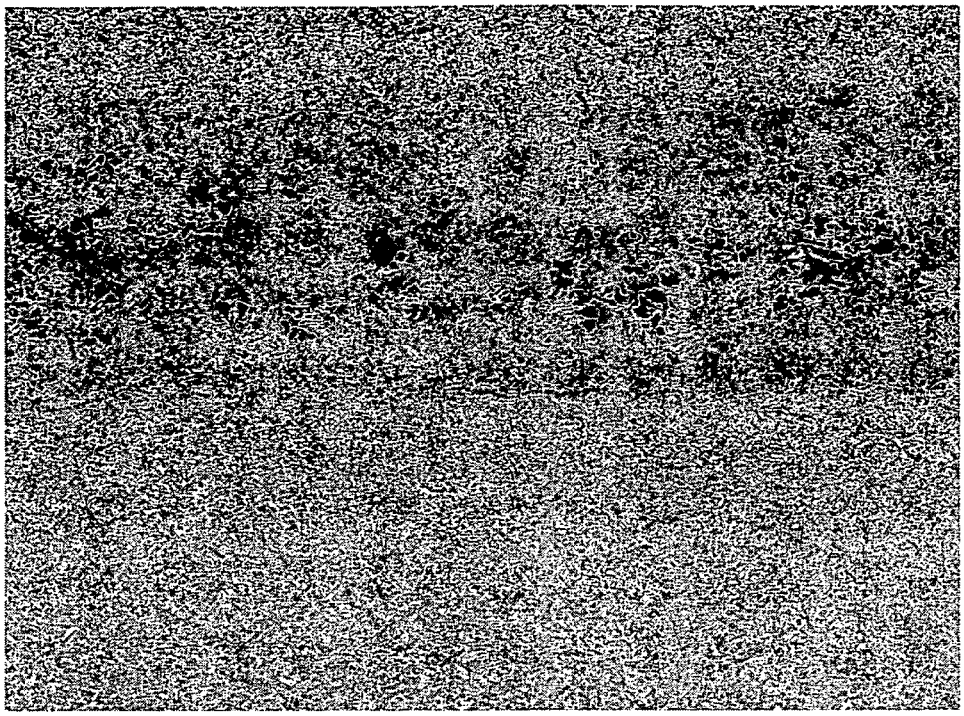
FIG. 3 is a representation of an SC-180 substrate repaired by the method depicted in FIG. 2, showing a metallurgically sound joint.
Figure 4:
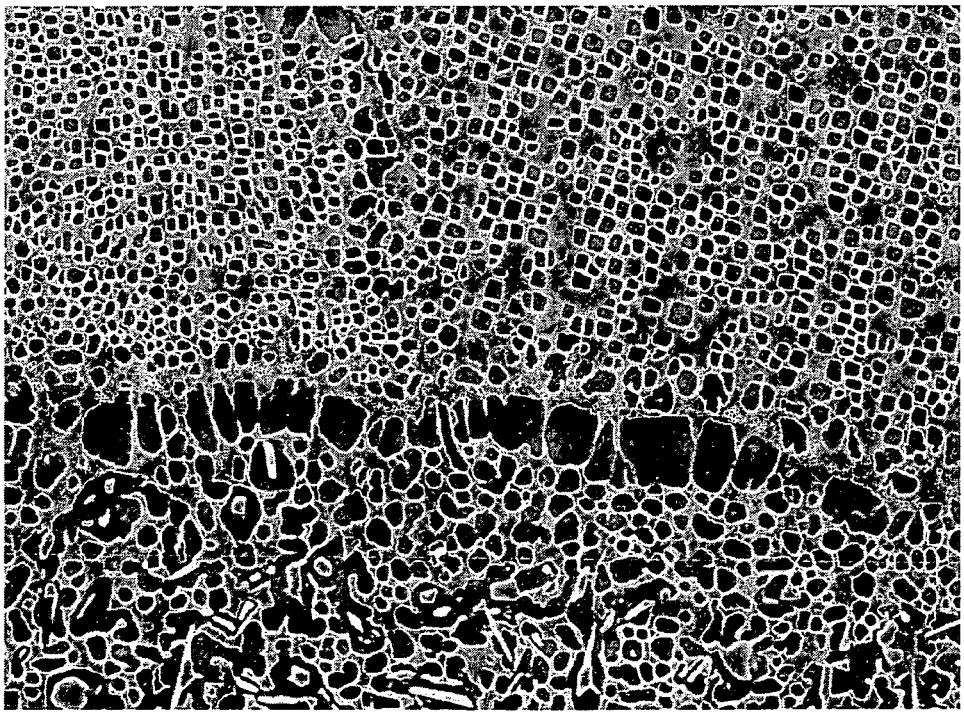
FIG. 4 is a close up view of a portion of the substrate of FIG. 3, showing high volume fraction of gamma prime in the joint and the base alloy.

As shown in FIGS. 3 and 4, the samples manufactured by the above-mentioned process were found to be metallurgically homogenized, and more structurally robust than conventional repaired joints. FIG. 3 is a micrograph depicting a cross section of a butt joint. As shown in FIG. 3, the joint is metallurgically sound and includes distinct diffusion zones. FIG. 4 is a close up view of the joint showing a high volume fraction of gamma prime at the joint/substrate interface. As a result, repaired components manufactured by the above process have elevated-temperature properties and better performance.

Example 2

In another example, samples were used that were made of a MarM247 superalloy, having a nominal composition of about 10% by weight Co, about 8.0% by weight Cr, about 0.6% by weight Mo, about 10% by weight W, about 3.0% by weight Ta, about 5.6% by weight Al, about 1.0% by weight Ti, about 1.5% by weight Hf, about 0.15% by weight C about 0.05% by weight Zr, about 0.015% by weight B, and balance Ni. A repair alloy mixture was made that included about 50% by weight of a high-melt alloy comprising MarM247 and about 50% by weight of a low-melt alloy disclosed as Embodiment 1 under Table 1 above. The repair alloy mixture was mixed with a chemical binder to make a paste, in which the repair alloy mixture made up about 88% by weight and the binder made up about 12% by weight of the paste. The samples included a 0.010-inch wide crack that was filled with the repaired alloy paste. The samples were heated to 1000° F. and held for about 15 minutes in order to burn off an organic binder that was in the brazing paste. The temperature was then increased to 2200° F. and held for between about 15 and about 45 minutes. Subsequently, the temperature was reduced to just below the liquidus temperature of the low-melt alloy, and held for 4-20 hours to allow a solid state diffusion to occur. As a result, the repaired area or brazing joint became metallurgically homogenized. Afterwards, the samples were solution heat treated at 2165° F. for about 2 hours, and then coated with a diffusion aluminide or MCrAlY coating. The coating was diffused at 1950° F. for about 4 hours, and then aged at 1600° F. for about 20 hours. The samples were metallurgically homogenized, and more structurally robust than conventional repaired joints. As a result, repaired components have elevated-temperature properties and better performance The present invention thus provides novel low-melt nickel-based alloys and an improved method for repairing turbine engine components. The repair method restores the components and improves their durability, thereby optimizing the operating efficiency of a turbine engine, and prolonging the operational life of turbine blades and other engine components.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. A low-melt nickel-based alloy powder for use in a braze alloy composition, the nickel-base alloy powder comprising:
between about 6.7% and about 9.2% by weight Cr;
between about 9.7% and about 10.3% by weight Co;
between about 3.7% and about 4.7% by weight W;
between about 3.3% and about 6.3% by weight Ta;
between about 3.6% and about 5.2% by weight Al;
between about 1.3% and about 4.0% by weight Hf;
between about 0.02% and about 0.06% by weight C;
between about 2.3% and about 3.2% by weight B; and
a balance of Ni.

2. The low-melt nickel-based alloy powder of claim 1, further comprising:
between about 1.4% and about 3.2% by weight Re.

3. The low-melt nickel-base alloy powder of claim 2, further comprising:
between about 6.7% and about 7.3% by weight Cr;
between about 5.7% and about 6.3% by weight Ta; and
between about 4.8% and about 5.2% by weight Al.

4. The low-melt nickel-based alloy powder of claim 1, further comprising:
between about 8.7% and about 9.2% by weight Cr;
between about 3.3% and about 3.7% by weight Ta; and
between about 3.6% and about 4.0% by weight Al.

5. A low-melt nickel-based alloy powder for use in a braze alloy composition, the nickel-base alloy powder comprising:
between about 6.7% and about 7.3% by weight Cr;
between about 9.7% and about 10.3% by weight Co;
between about 3.7% and about 4.2% by weight W;
between about 5.7% and about 6.3% by weight Ta;
between about 4.8% and about 5.2% by weight Al;
between about 1.3% and about 1.7% by weight Hf,
between about 0.02% and about 0.06% by weight C;
between about 2.8% and about 3.2% by weight B; and
a balance of Ni.

6. The low-melt nickel-based alloy powder of claim 5, further comprising:
between about 2.8% and about 3.2% by weight Re.

7. The low-melt nickel-based alloy powder of claim 5, further comprising:
about 7.0% by weight Cr;
about 10.0% by weight Co;
about 4.0% by weight W;
about 6.0% by weight Ta;
about 5.0% by weight Al;
about 1.5% by weight Hf,
about 0.04% by weight C;
about 3.0% by weight B; and
a balance of Ni.

8. The low-melt nickel-based alloy powder of claim 7, further comprising:

about 3.0% by weight Re.

9. A low-melt nickel-based alloy powder for use in a braze alloy composition, the nickel-base alloy powder comprising:

between about 8.7% and about 9.2% by weight Cr;
between about 9.7% and about 10.3% by weight Co;
between about 3.7% and about 4.2% by weight W;
between about 3.3% and about 3.7% by weight Ta;
between about 3.6% and about 4.0% by weight Al;
between about 1.3% and about 1.7% by weight Hf;
between about 0.02% and about 0.06% by weight C;
between about 2.3% and about 2.7% by weight B; and
a balance of Ni.

10. The low-melt nickel-based alloy powder of claim 9, further comprising:

about 9.0% by weight Cr;
about 10.0% by weight Co;
about 4.0% by weight W;
about 3.5% by weight Ta;
about 3.8% by weight Al;
about 1.5% by weight Hf;
about 0.04% by weight C;
about 2.5% by weight B; and
a balance of Ni.

* * * * *